US005609199A

United States Patent [19]

Kato et al.

[11] Patent Number: 5,609,199

[45] Date of Patent: Mar. 11, 1997

[54] METHOD OF MANUFACTURING STEEL CONTAINING CA

[75] Inventors: Yoshiei Kato; Seiko Nara, both of Chiba; Kenichi Sorimachi, Okayama, all of Japan

[73] Assignee: Kawasaki Steel Corporation, Japan

[21] Appl. No.: 489,994

[22] Filed: Jun. 12, 1995

[30] Foreign Application Priority Data

Jun. 14, 1994 [JP] Japan ..... 6-131981

[51] Int. Cl.[6] ..... B22D 11/10

[52] U.S. Cl. ..... 164/473; 164/56.1; 75/567

[58] Field of Search ..... 164/473, 55.1, 164/56.1, 57.1; 75/567

[56] References Cited

U.S. PATENT DOCUMENTS 5,228,902 7/1993 Bogan et al. .

FOREIGN PATENT DOCUMENTS

0451385A1 10/1991 European Pat. Off. .
56-139613 10/1981 Japan .
58-3913 1/1983 Japan .
61-179811 8/1986 Japan .

*Primary Examiner*—Kuang Y. Lin
*Attorney, Agent, or Firm*—Austin R. Miller

[57] ABSTRACT

A method of manufacturing steel having Ca including the steps of adding Ca metal or alloy containing Ca to molten steel in a ladle that has been killed by adding a reducing agent, such as Al, to the molten steel in a predetermined quantity when or after the molten steel has been discharged from a converter, subjecting the molten steel to a vacuum degasification process, and supplying the molten steel to a mold through a tundish so that the molten steel is continuously cast, wherein Ca metal or alloy containing Ca is added to the molten steel in the tundish.

6 Claims, 4 Drawing Sheets

METHOD OF MANUFACTURING STEEL CONTAINING CA

BACKGROUND OF THE INVENTION

1. Field of the Invention

Steel of a type for use in the corrosive environment of hydrogen sulfide, such as line pipe, must have excellent resistance against hydrogen induced cracks (hereinafter called "HIC resistance").

Means to improve HIC resistance must be capable of decreasing inclusions existing in the steel and controlling formation of the same to prevent accumulation of hydrogen in the steel. Accordingly, Ca is sometimes added to the steel in the melting step to control formation of inclusions.

Controlling formation of inclusions by adding Ca is performed to prevent generation of MnS and to form CaS. MnS inclusions become elongated in the direction of rolling and deteriorate HIC resistance. Furthermore, oxide inclusions, for example, $Al_2O_3$, which also deteriorate HIC resistance, are converted to, for example, $CaO \cdot Al_2O_3$ to lower its melting point, accumulate, combine and coarsen. This allows the $CaO \cdot Al_2O_3$ to float and separate for easy removal. Thus, clean steel including few inclusions can be manufactured. Therefore, HIC resisting steel has been manufactured by adding Ca in such a manner that the level of sulfur in molten steel is lowered and then Ca is added.

According to the present invention, there is provided a method of manufacturing steel having Ca added thereto that is capable of satisfactorily controlling formation of inclusions and reducing the same.

2. Related Background Art

Hitherto, Ca has been added in a process of manufacturing steel having Ca added thereto by a known method comprising the steps of, in a secondary refining step after molten steel has been refined in a converter, subjecting the molten steel in a ladle to a desulfurization flux process; and continuously adding Ca alloy particles or Ca alloy to the molten steel in the ladle. Another method has been known which comprises the step of continuously or intermittently adding Ca alloy to molten steel in a tundish for use in a continuous casting process.

Although the method in which Ca alloy particles or Ca alloy wires are continuously added in molten steel in a ladle allows a sufficiently long time to be taken to control formation of inclusions, an excessively long time is required to cast the molten steel. As a result, the yield of Ca is generally unsatisfactory and unstable, thus resulting in considerable scattering of the quantity of remaining Ca. Thus, there arise problems in that formation of inclusions cannot satisfactorily be controlled and that the same cannot stably be controlled.

On the other hand, the method in which the Ca alloy is added to molten steel in a tundish exhibits excellent yield of Ca. However, there arises a problem in that the time taken from the addition of the Ca alloy to perform the casting operation is too short to satisfactorily control formation of inclusions.

As a method that is capable of overcoming the foregoing problems, a method has been disclosed in JP56-139613, the title of which is "METHOD OF MANUFACTURING CLEAN STEEL", and in which Ca alloy is added in two steps, namely Ca alloy is added to molten steel in the ladle and to the molten steel in the tundish.

The method disclosed in JP56-139613 will now be described specifically. That method comprises:

(1) a step in which molten steel in a ladle, which has been deoxidized with Al so as to be killed after it has been discharged from a converter, is subjected to a vacuum degasification process, and then Ca is added while stirring the molten steel with Ar gas, followed by continuously stirring the molten steel with Ar gas after Ca has been added; and (2) a step in which the molten steel is, through a tundish, supplied to a mold so as to be continuously cast in such a manner that Ca alloy or alloy containing Ca is continuously added to the molten steel in the tundish.

The method disclosed in JP56-139613 has as an essential portion that Ca is added after molten steel in the ladle has been subjected to the vacuum degasification process.

The inventors of the invention disclosed in JP56-139613 considered that subjecting molten steel to the vacuum degasification process after Ca has been added to the molten steel in the ladle must be avoided. The reason for this is that evaporation of molten Ca and dissociation of low-melting-point $CaO\text{-}Al_2O_3$ inclusions causes the melting point of the inclusions to be raised and, thus, the quantity of Ca that must be added to the molten steel in the tundish is enlarged and the cleanability of the steel undesirably deteriorates.

However, the method disclosed in JP56-139613 cannot satisfactorily perform, in the first Ca addition step, deoxidation by means of Ca in such a manner that the Ca alloy added to molten steel in the ladle lowers the melting point of inclusions by converting the $Al_2O_3$ inclusions into $CaO\text{-}Al_2O_3$ and cause the inclusions to float and separate from the molten steel. Thus, the foregoing method suffers from a problem in that the quantity of Ca that must be added to molten steel in the tundish in the second step cannot clearly be calculated. As a result, there arise problems in that oversupply or shortage of Ca inhibits satisfactory control of inclusion formation, excess addition of Ca results in unsatisfactory cost reduction, and excess Ca deteriorates the quality of the steel.

OBJECT OF THE INVENTION

Therefore, an object of the present invention is to provide a method of manufacturing steel having Ca added thereto that is capable of effectively performing deoxidation by means of Ca in such a manner that Ca metal or Ca alloy is added to molten steel in a ladle, lowering the melting point of inclusions and causing the inclusions to float and separate in the first step to make appropriate the quantity of Ca metal or Ca alloy to be added to the molten steel in the tundish in the second step for the purpose of reducing the cost and obtaining steel exhibiting excellent quality.

Other objects and advantages of the invention will become apparent to those skilled in the art from the drawings, the detailed description of embodiments and the appended claims.

SUMMARY OF THE INVENTION

According to the present invention, there is provided a method of manufacturing steel having Ca added thereto, comprising the steps of: adding Ca metal or alloy containing Ca to molten steel in a ladle that has been killed by adding a reducing agent, such as Al, to the molten steel in a predetermined quantity when or after the molten steel has been discharged from a converter; subjecting the molten steel to a vacuum degasification process; and supplying the molten steel to a mold through a tundish so that the molten steel is continuously cast, wherein Ca metal or alloy containing Ca is added to the molten steel in the tundish.

DESCRIPTION OF PREFERRED EMBODIMENTS

It is preferable for the present invention that, before or after the Ca metal or the alloy containing Ca has been added to the killed molten steel in the ladle, the temperature of the molten steel is adjusted to a predetermined level, and a desulfurization process is performed by using flux that contains CaO.

It is also preferable in the present invention that the concentration of Ca in the molten steel, after the Ca metal or the alloy containing Ca has been added to the molten steel in the tundish, satisfies Equation (1) below:

$$0.5 \leqq [Ca]/[S] \leqq 6 \quad (1)$$

wherein

[Ca]: concentration (wt %) of Ca in the molten steel after the Ca metal or the alloy containing Ca has been added to the molten steel in the tundish,

[S]: concentration (wt %) of S in the molten steel after the molten steel has been subjected to the vacuum degasification process.

As described above, a method has been disclosed in JP56-139613, in which Ca alloy is added in two steps such that the Ca alloy is added to molten steel in the ladle and the Ca alloy is added to the molten steel in the tundish.

Figure 4:
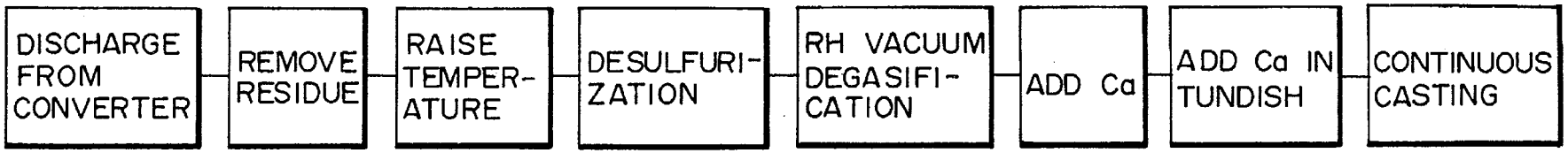
FIG. 4 PRIOR ART
FIG. 4 is a block diagram of steps of a comparative process of a method disclosed in JP56-139613.

Important differences between the method according to the present invention and that disclosed in JP56-139613 will now be described. The method disclosed in JP56-139613 is quite different from the present invention in that in JP56-139613, as shown in FIG. 4, molten steel in a ladle, which has been deoxidized with Al so as to be killed after it has been discharged from a converter, is subjected to a vacuum degasification process, and then Ca is added while stirring the molten steel with Ar gas, followed by continuous stirring with Ar gas after Ca has been added.

JP56-139613 considered that subjecting the molten steel to the vacuum degasification process after Ca has been added to the molten steel in the ladle must be avoided. Those inventors apparently believed that evaporation of molten Ca and dissociation of low-melting-point $CaO\text{-}Al_2O_3$ inclusions causes the melting point of the inclusions to be raised and, thus, the quantity of Ca that must be added to the molten steel in the tundish is enlarged and the cleanability of steel undesirably deteriorates. Therefore, addition of Ca in the first step is performed after the vacuum degasification process has been performed in JP56-139613.

Figure 1:
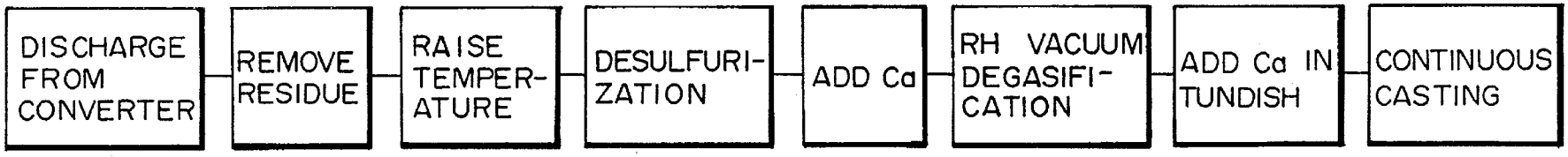
FIG. 1 is a block diagram of steps of an embodiment of a process according to the present invention.

On the other hand, the inventors of the present invention, as shown in FIG. 1, discovered that the stirring force occurring in the vacuum degasification process causes inclusions to float and separate and, therefore, the undesirable rise in the melting point due to dissociation can be ignored. Furthermore, the presence of Ar employed in the method disclosed in JP56-139613 causes residual Ca to be combined with oxygen in the atmosphere even though Ar is provided. Thus, the molten steel is contaminated. Accordingly, the inventors herein discovered that it is advantageous to evaporate Ca by a vacuum degasification process to prevent the molten steel from being contaminated.

Addition of Ca to the killed molten steel is performed in two steps in the invention. Addition in the first step is performed such that Ca metal or alloy containing Ca is added to molten steel in a ladle that has been killed by adding a reducing agent, such as Al, to the molten steel in a predetermined quantity when or after the molten steel has been discharged from a converter. Then, the vacuum degasification process is performed.

In the vacuum degasification process, $Al_2O_3$ is converted into $CaO\text{-}Al_2O_3$ inclusions and the inclusions are removed from the molten steel as much as possible. Furthermore, excess Ca is evaporated.

Then, addition of Ca in the second step to the molten steel in the tundish of the casting apparatus is performed. The quantity of Ca to be added in the second step may be a quantity that corresponds to the quantity of sulfur dissolved in the foregoing step because the concentration of oxygen dissolved in the steel has been lowered considerably. Therefore, undesirable generation of MnS can efficiently be prevented.

In order to reduce the quantity of Ca to be added and to improve the cleanability of the steel, it is preferable that, before or after the Ca metal or the alloy containing Ca has been added to the killed molten steel, the temperature of the molten steel be raised to a predetermined level, and a desulfurization process be performed by using flux that contains CaO.

According to the present invention, the vacuum degasification process performed after Ca has been added in the first step permits the concentration of oxygen dissolved in the steel to be reduced considerably and the quantity of dissolved Ca can be decreased to substantially zero, as described above. Therefore, the quantity of Ca to be added in the second step can be reduced to a quantity that corresponds to the quantity of sulfur dissolved at the foregoing moment.

As a result of stoichiometric investigation and actual and detailed examination of the reaction efficiency performed in the examples, it has been determined that it is preferable that the quantity of Ca and S satisfies Equation (1) below:

$$0.5 \leqq [Ca]/[S] \leqq 6 \quad (1)$$

wherein

[Ca]: concentration (wt %) of Ca in the molten steel after the Ca metal or the alloy containing Ca has been added to the molten steel in the tundish and

[S]: concentration (wt %) of S in the molten steel after the molten steel has been subjected to the vacuum degasification process.

Therefore, it is preferable that the quantity of Ca added in the second step is adjusted in accordance with the quantity of Ca in the molten steel calculated in accordance with Equation (1).

As described above, according to the present invention, deoxidation and control of the formation of inclusions in the molten steel can reliably be performed. Furthermore, an excellent yield of Ca can be realized, the quantity of added Ca can be stably controlled, the quality of the obtained cast articles is improved and, thus, excellent cost reduction effect can be obtained.

Specific examples of the invention and conventional methods are described below as follows:

280 to 300 tons of molten steel discharged from a converter and containing C by 0.025 to 0.040 wt %, Mn by 1.0 to 1.2 wt %, P by 0.01 wt % or less and S by 0.003 to 0.004 wt % were used in a method of adding Ca to molten steel in a ladle according to the present invention and conventional example (1); a method of adding Ca to molten steel in a tundish according to conventional example (2); and a comparative example of method of adding Ca in such a manner that molten steel in the ladle was subjected to a vacuum degasification process, and then Ca was added into the ladle while stirring the molten steel with Ar gas, after Ca had been added, stirring with Ar gas was continuously performed, followed by adding Ca to molten steel in the tundish (the method disclosed in JP56-139613). Thus, steel having Ca added thereto was manufactured, and then continuous casting was performed.

Figure 2:
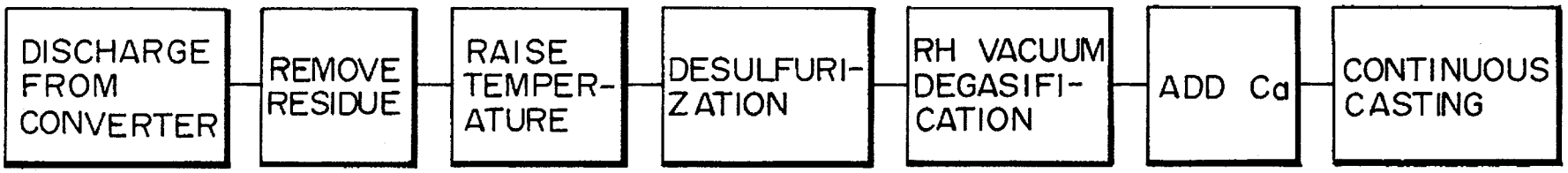
FIG. 2 PRIOR ART
FIG. 2 is a block diagram of steps of a conventional process of a method of adding Ca to molten steel in a ladle.
Figure 3:
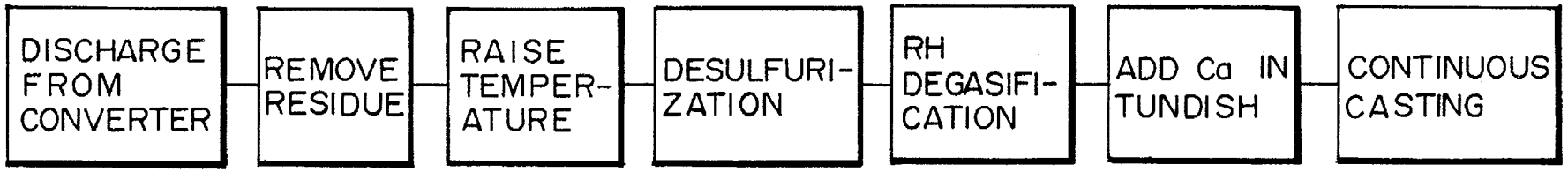
FIG. 3 PRIOR ART
FIG. 3 is a block diagram of steps of a conventional process of adding Ca to molten steel in a tundish.

The process according to the present invention is shown in FIG. 1. The processes according to conventional examples (1) and (2) and the comparative example are shown in FIGS. 2, 3 and 4, respectively.

Residue was removed after the molten steel had been discharged from the converter, and then the temperature of the molten steel was raised by using an AC electrode. Deoxidation was performed by adding Al and then desulfurization refining was performed by using flux (5 to 10 kg/t) of CaO (60%)-$CaF_2$ (40%).

The temperature of the molten steel subjected to the desulfurization refining process was 1630° to 1640° C. and the molten steel contained S, O and Al such that S was contained by 0.0005 to 0.0015 wt %, O was contained by 20 to 30 mass ppm and Al was contained by 0.02 to 0.04 wt %.

Then, the contents of S, O and Ca in samples each taken from a portion of the molten steel were subjected to a RH vacuum degasification process. The cast articles obtained due to the continuous casting process in the widthwise central portion at a quarter position in the direction of thickness of the same were measured. Furthermore, the weight ratio $CaO/Al_2O_3$ in $CaO \cdot Al_2O_3$ inclusions was measured.

Then, the HIC resistance of each of the steel plates obtained by rolling respective cast articles under the same rolling conditions was examined.

The conditions of the process according to the present invention and the conventional processes and results of examination will now be described.

Example

Ar with a flow rate of 2 $Nm^3$/minute was used to blow particles of an alloy of Ca and Si (Ca: 30% and Si: 60%), through a lance, into molten steel subjected to desulfurization and placed in a ladle at a rate of 40 to 60 kg per minute, the quantity of the particles being 50 to 100 kg per charge. After Ca was blown into the molten steel, an RH vacuum degasification apparatus was used so that a vacuum degasification process was performed for 10 minutes under conditions that the degree of vacuum was 0.2 to 1.0 Torr.

The results of measurements of the temperature of the molten steel and the quantities of S, O and Ca before and after the vacuum degasification process were performed will now be described.

Temperature of the molten steel:

1610° to 1620° C. (before the process) →1580° to 1595° C. (after the process)

Contents

S: 0.0005 to 0.0015 wt % (before the process) →0.0004 to 0.0015 wt % (after the process)

O: 18 to 30 wt ppm (before the process) →5 to 16 wt ppm (after the process)

Ca: 15 to 20 wt ppm (before the process) →3 to 5 wt ppm (after the process)

After the vacuum degasification process was performed, an alloy of Ca and Si having the same composition as that of the foregoing alloy was, at a rate of 0.7 to 1.0 kg per minute in each charge, added to the molten steel in the tundish of the continuous casting apparatus.

Conventional Example (1)

(Method in which Ca was added to molten steel in the ladle)

A vacuum degasification process was performed for 10 minutes in an RH vacuum degasification apparatus, and then carrier gas with a flow rate of 2 $Nm^3$/minute was used to blow particles of alloy of Ca and Si through a lance at a rate of 40 to 60 kg/minute and in a quantity of 150 to 250 kg per charge into molten steel subjected to the desulfurization process and placed in the ladle.

The carrier gas and the particles of alloy of Ca and Si were the same as those used in the example according to the present invention.

Conventional Example (2)

(Method in which Ca was added to molten steel in the tundish)

Immediately after molten steel in the ladle subjected to the desulfurization process, the molten steel was subjected to the vacuum degasification process for 10 minutes in the RH vacuum degasification apparatus. Then, in the continuous casting step, particles of alloy of Ca and Si were continuously added to the molten steel in the tundish at a rate of 1.2 to 1.6 kg/minute and in a quantity of 100 to 200 kg per charge.

The particles of alloy of Ca and Si were the same as those used in the example according to the present invention.

Comparative Example (Method disclosed in JP56-139613)

Molten steel subjected to the desulfurization process was subjected to a vacuum degasification process for 10 minutes in the RH vacuum degasification apparatus. Then, a cover was placed in the upper portion of the ladle, and Ar gas was substituted for air in the ladle. The concentration of oxygen in the ladle was lowered to 0.2% or lower. Then, particles of alloy of Ca and Si were blown into molten steel in the ladle through a lance at a rate of 40 to 60 kg/minute and in a quantity of 50 to 100 kg per charge.

Then, in the continuous casting process, particles of alloy of Ca and Si were blown into molten steel in the tundish at a rate of 0.7 to 1.0 kg/minute and in a quantity of 30 to 50 kg per charge.

The particles of alloy of Ca and Si were the same as those used in the example according to the present invention.

The contents of S, O and Ca and the weight ratio $CaO/Al_2O_3$ in $CaO \cdot Al_2O_3$ inclusions in the samples taken in the example according to the present invention, conventional examples (1) and (2) and the comparative examples are collectively shown in Table 1.

TABLE 1

| SAMPLE | S (wt %) | O (wt ppm) | Ca (wt ppm) | $CaO/Al_2O_3$ |
|---|---|---|---|---|
| THIS INVENTION | 0.0004–0.0015 | 5–13 | 8–24 | 0.6–1.4 |
| CONVENTIONAL EXAMPLE (1) | 0.0005–0.0015 | 13–19 | 9–21 | 0.3–0.7 |
| CONVENTIONAL EXAMPLE (2) | 0.0006–0.001 | 14–21 | 10–24 | 0.1–0.4 |
| COMPARATIVE EXAMPLE | 0.0005–0.0014 | 13–20 | 10–19 | 0.3–0.7 |

As can be understood from Table 1, the cast articles according to the present invention contained S and Ca in substantially the same quantities as those contained in the cast articles according to conventional examples (1) and (2) and the comparative example. However, the low $CaO/Al_2O_3$ ratio in $CaO \cdot Al_2O_3$ inclusions, which approximated 1, indicated that the formation of inclusions was satisfactorily controlled.

When the weight ratio of CaO and $Al_2O_3$ was about 1, the $CaO \cdot Al_2O_3$ inclusions had the lowest melting point.

Steel plates manufactured by rolling, under the same rolling conditions, the cast articles according to the present invention, conventional examples (1) and (2) and the comparative example were subjected to a HIC resistance test. As a result, twenty of twenty samples according to the present invention were not broken, eleven of twenty samples according to conventional example 1 were broken, nine of twenty samples according to conventional example 2 were broken, and eight of twenty samples according to the comparative example were broken.

As a result, the steel plates according to the present invention exhibited excellent HIC resistance.

The HIC resistance test was performed in such a manner that tests samples were, for two weeks, dipped in $H_2S$ saturated (pH 2.7 to 2.8) solution containing 5% NaCl and 0.5% to examine occurrence of breakage.

According to the present invention, inclusions can be reduced, the concentration of Ca can be stably controlled so that cost reduction is enabled, the formation of inclusions can stably be controlled, and steel manufactured by the method according to the present invention exhibits excellent HIC resistance.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. A method of manufacturing steel having Ca added thereto, comprising the steps of:

preparing a molten steel;

killing said molten steel by adding a reducing agent;

adding Ca metal or alloy containing Ca to said killed molten steel in a predetermined quantity when or after said molten steel has been discharged from a converter;

subjecting said molten steel containing Ca to a vacuum degasification process;

introducing said degasified molten steel into a tundish;

adding additional Ca metal or alloy containing Ca to said degasified molten steel while said degasified molten steel is in said tundish; and supplying said molten steel containing additional Ca to a mold through said tundish so that said molten steel is continuously cast.

2. A method according to claim 1, wherein, before or after said step of adding Ca metal or alloy containing Ca to said killed molten steel, the temperature of said molten steel is adjusted to a predetermined level, and a desulfurization process is performed by using flux containing CaO.

3. A method according to claim 1, wherein the concentration of Ca in said molten steel after said step of adding additional Ca metal or alloy containing Ca to said degasified molten steel while said degasified molten steel is in said tundish satisfies Equation (1) below:

$$0.5 \leqq [Ca]/[S] \leqq 6 \quad (1)$$

wherein

[Ca]: concentration (wt %) of Ca in the molten steel after said step of adding additional Ca metal or the alloy containing Ca to said degasified molten steel while said degasified molten steel is in said tundish and

[S]: concentration (wt % ) of S in said molten steel after said molten steel has been subjected to said vacuum degasification.

4. A method according to claim 2, wherein the concentration of Ca in the molten steel, after said step of adding additional Ca metal or alloy containing Ca to said degasified molten steel while said degasified molten steel is in said randish, satisfies Equation (1) below:

$$0.5 \leqq [Ca]/[S] \leqq 6 \quad (1)$$

wherein

[Ca]: concentration (wt %) of Ca in the molten steel after said step of adding additional Ca metal or the alloy containing Ca to said degasified molten steel while said degasified molten steel is in said randish and

[S]: concentration (wt % ) of S in said molten steel after said molten steel has been subjected to said vacuum degasification.

5. A method according to claim 1 wherein said step of adding Ca metal or alloy containing Ca to said killed molten steel is performed in a ladle.

6. A method according to claim 1 wherein said reducing agent is Al.

* * * * *